US006908337B1

(12) United States Patent
Li

(10) Patent No.: US 6,908,337 B1
(45) Date of Patent: Jun. 21, 2005

(54) CABLE TERMINAL

(75) Inventor: Jackie Li, Tai Li (TW)

(73) Assignee: Cablesat International Co., Ltd., Taichung (TW)

( * ) Notice: Subject to any disclaimer, the term of this patent is extended or adjusted under 35 U.S.C. 154(b) by 0 days.

(21) Appl. No.: 10/967,146

(22) Filed: Oct. 19, 2004

(51) Int. Cl.[7] ..... H01R 9/05
(52) U.S. Cl. ..... 439/578
(58) Field of Search ..... 439/578–585

(56) References Cited

U.S. PATENT DOCUMENTS 5,002,503 A * 3/1991 Campbell et al. ..... 439/578
5,167,533 A * 12/1992 Rauwolf ..... 439/583
5,217,393 A * 6/1993 Del Negro et al. ..... 439/585
6,183,297 B1 * 2/2001 Kay et al. ..... 439/578
2003/0114045 A1 * 6/2003 Montena ..... 439/578
2004/0110416 A1 * 6/2004 Montena et al. ..... 439/578

* cited by examiner

*Primary Examiner*—Michael C. Zarroli
(74) *Attorney, Agent, or Firm*—Browdy and Neimark, P.L.L.C.

(57) ABSTRACT

A cable terminal has a base having a hole, a large portion, a small portion and an annular wall therebetween. The small portion has an annular protrusion and a tilted guiding flat beside the annular protrusion. An outer member has a hole and on a sidewall of the hole is a first protrusion portion, a second protrusion portion, a stop portion and a thread in sequence. The outer member is fitted to the smaller portion of the base with the first protrusion portion crossing the guiding flat and engaged with the annular protrusion. An engaging member is received in both of the base and the outer member and has a plate against the stop portion of the outer member to move the outer member toward the base, in which the first protrusion portion is moved to where between the annular flat and the annular protrusion.

4 Claims, 5 Drawing Sheets

CABLE TERMINAL

BACKGROUND OF THE INVENTION

1. Field of the Invention

The present invention relates generally to a cable, and more particularly to a cable terminal.

2. Description of the Related Art

FIG. 1 and FIG. 2 show a conventional cable terminal 60, which has a base 61, an outer member 62 and an engaging member 63. The base 61 is a round tube fitted to the cable. The outer member 62 is a hexagonal tube with a round hole and on a sidewall of the hole is a thread 621. An end of the outer member 62 is rested on an end of the base 61. The engaging member 63, which is a round tube, is inserted into both of the base 61 and the outer member 62 and has a protrusion 631 at an end thereof to stop the outer member 62. The engaging member 63 has an end in the base 61 inserted into a cable between an insulating layer and an isolating layer (not shown). In connection with an electric product, such as television, the outer member 61 is turned to tighten or loose the terminal.

However, the base 61 is round and the terminal 60 is small that user has to use tool, such as pliers or wrench, to hold the outer member 62 and exerts the engaging member 63 into the cable. But the outer member 62 is free for rotation, such that it is hard to be held, even the tool is applied. The work of engaging the conventional terminal 60 with the cable is a hard job.

SUMMARY OF THE INVENTION

The primary objective of the present invention is to provide a cable terminal, which is easier to be connected to the cable.

According to the objective of the present invention, a cable terminal comprises a base having a hole, a large portion, a small portion and an annular wall between the large portion and small portion. The small portion has an annular protrusion at a circumference thereof and a tilted guiding flat beside the annular protrusion. An outer member has a hole having a plurality of sections with various diameters. A first protrusion portion is formed on a sidewall of the narrowest section of the hole, a second protrusion portion is formed on the sidewall of the hole next to the first protrusion portion, a thread is formed on the sidewall of the widest section of the hole and a stop portion is formed between the second protrusion portion and the thread. The diameter of the hole at the first protrusion portion is greater than that of the small portion of the base and is smaller than that of the annular protrusion of the base. The outer member is fitted to the smaller portion of the base with the first protrusion portion crossing the guiding flat and engaged with the annular protrusion. An engaging member is received in both of the base and the outer member and has a plate at an end thereof against the stop portion of the outer member to move the outer member toward the base. The first protrusion portion is moved to where between the annular flat and the annular protrusion of the base.

DETAILED DESCRIPTION OF THE INVENTION

Figure 1:
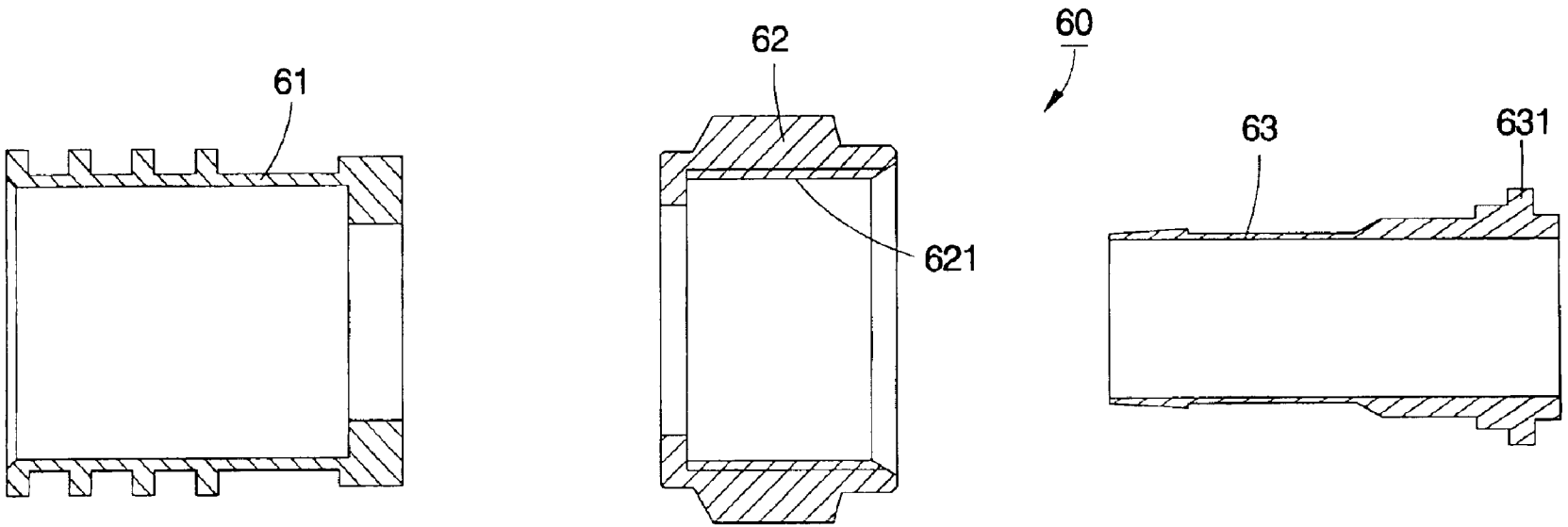
FIG. 1 PRIOR ART
FIG. 1 is a sectional view of a conventional cable terminal in the exploded condition.
Figure 2:
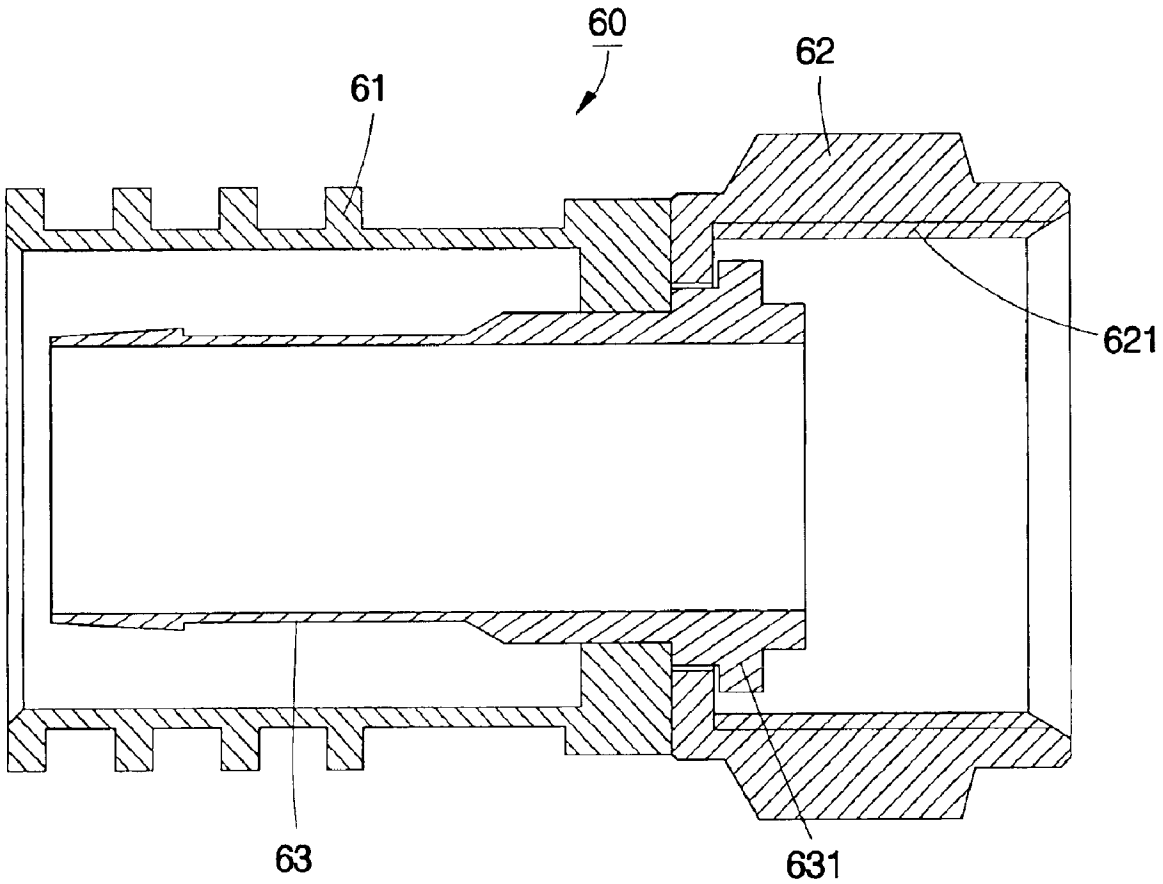
FIG. 2 PRIOR ART
FIG. 2 is a sectional view of the conventional cable terminal in the combinative condition.
Figure 3:
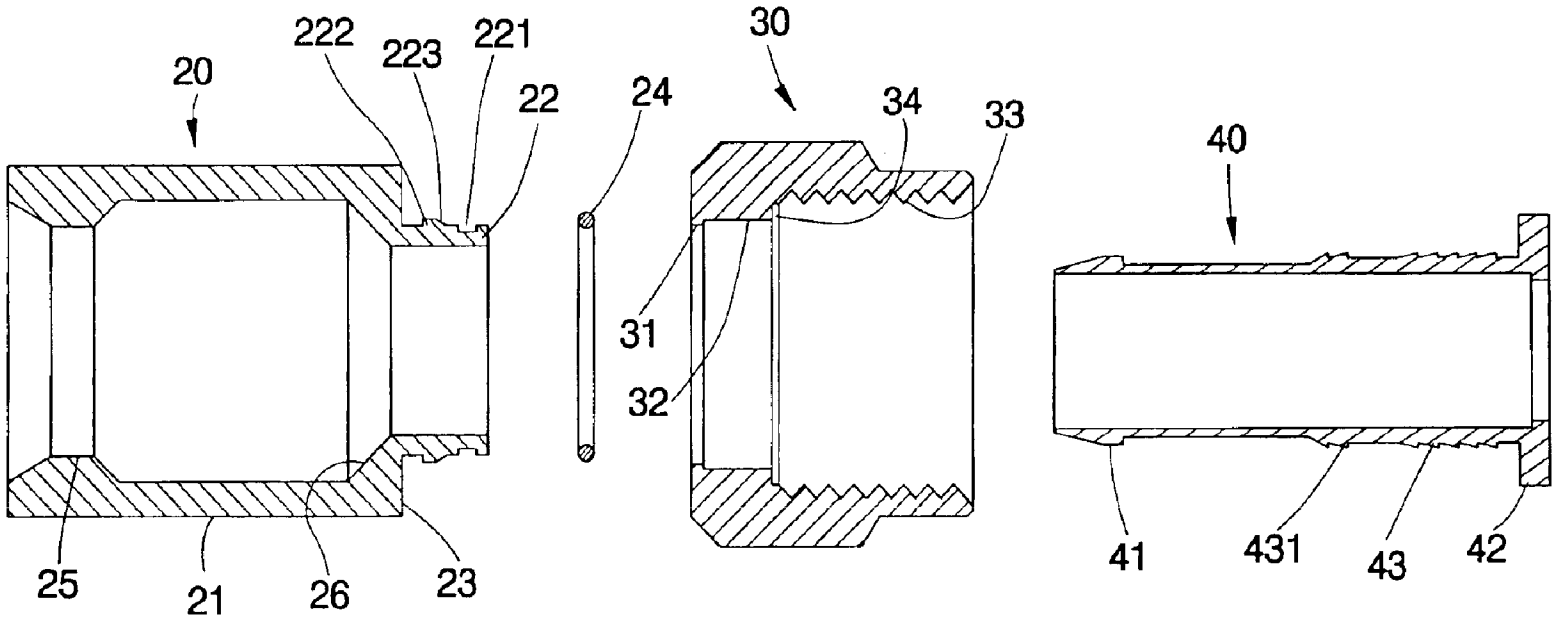
FIG. 3 is a sectional view of a preferred embodiment of the present invention in the exploded condition.

As shown in FIG. 3, a cable terminal 10 of the preferred embodiment of the present invention comprises a base 20, an outer member 30 and an engaging member 40.

The base 20 is a round tube with a large portion 21, a small portion 22 and an annular wall 23 between the large portion 21 and the small portion 22. The small portion 22 has, from a distal end, an annular slot 221, a tilting guiding flat 223 and an annular protrusion 222 on an outer surface thereof. A ring 24 is fitted to the small portion 22 and rested in the slot 221. The large portion 21 has a first engaging portion 25 at an interior surface thereof and a stop flat 26 beside the first engaging portion 25 and adjacent to the small portion 22.

The outer member 30 is a hexagonal tube with a three-order round hole, wherein on a sidewall of the hole is a first protrusion portion 31, from an end thereof, a second protrusion portion 32, a stop portion 34 and a thread 33. A diameter of the hoe at the first protrusion portion 31 is greater than that of the small portion 22 of the base 20 but is smaller than the annular protrusion 222. The outer member 30 is fitted to the base 20, in which the first protrusion portion 31 of the out member 30 moves along the guiding flat 223 to be engaged with the annular protrusion 222 of the base 20.

The engaging member 40 has a hook-like second engaging portion 41 at an end, a plate 42 at the other end and a teeth portion 43, which has tilted teeth 431, at a circumference thereof adjacent to the plate 42. In assembly, the engaging member 40 is inserted into both of the base 20 and the outer member 30, in which the plate is attached on the second protrusion portion 32 of the outer member 30.

Figure 4:
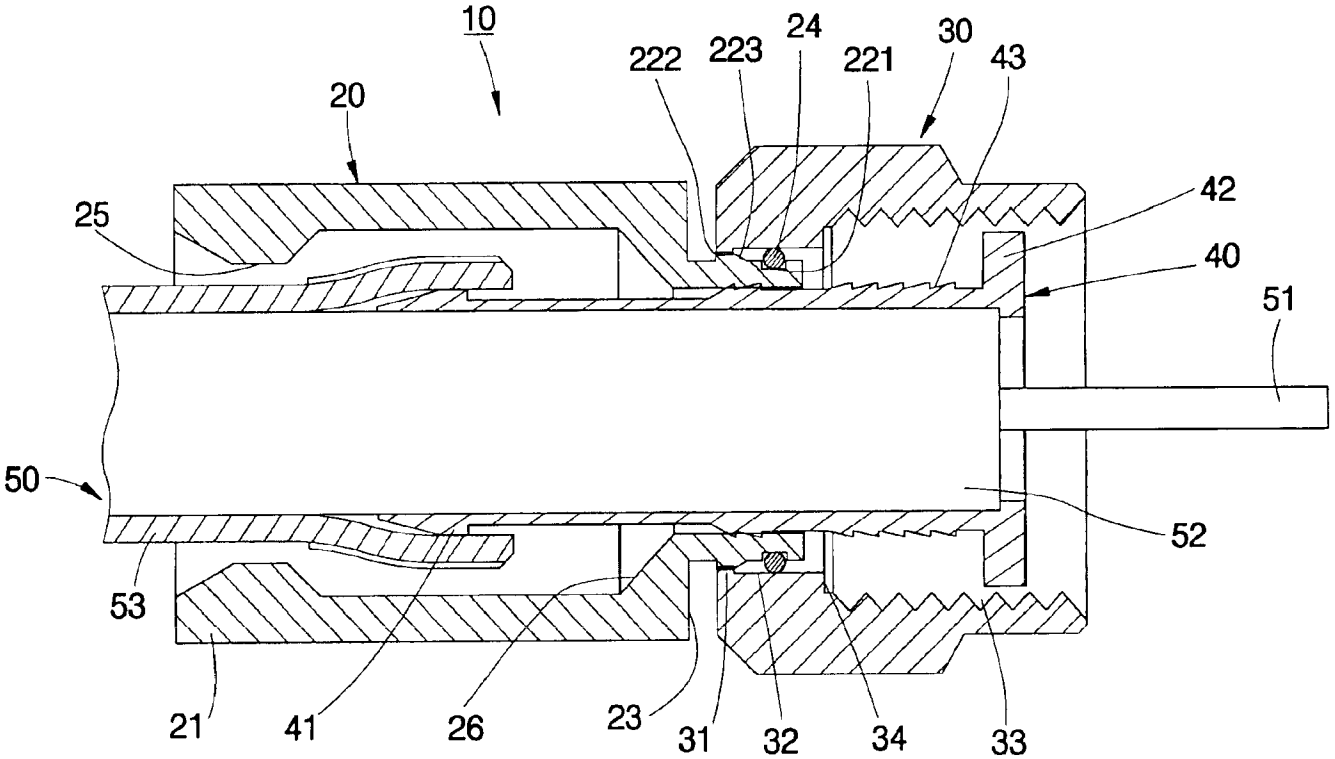
FIG. 4 is a sectional view of the preferred embodiment of the present invention and a cable is going to be connected thereto.
Figure 5:
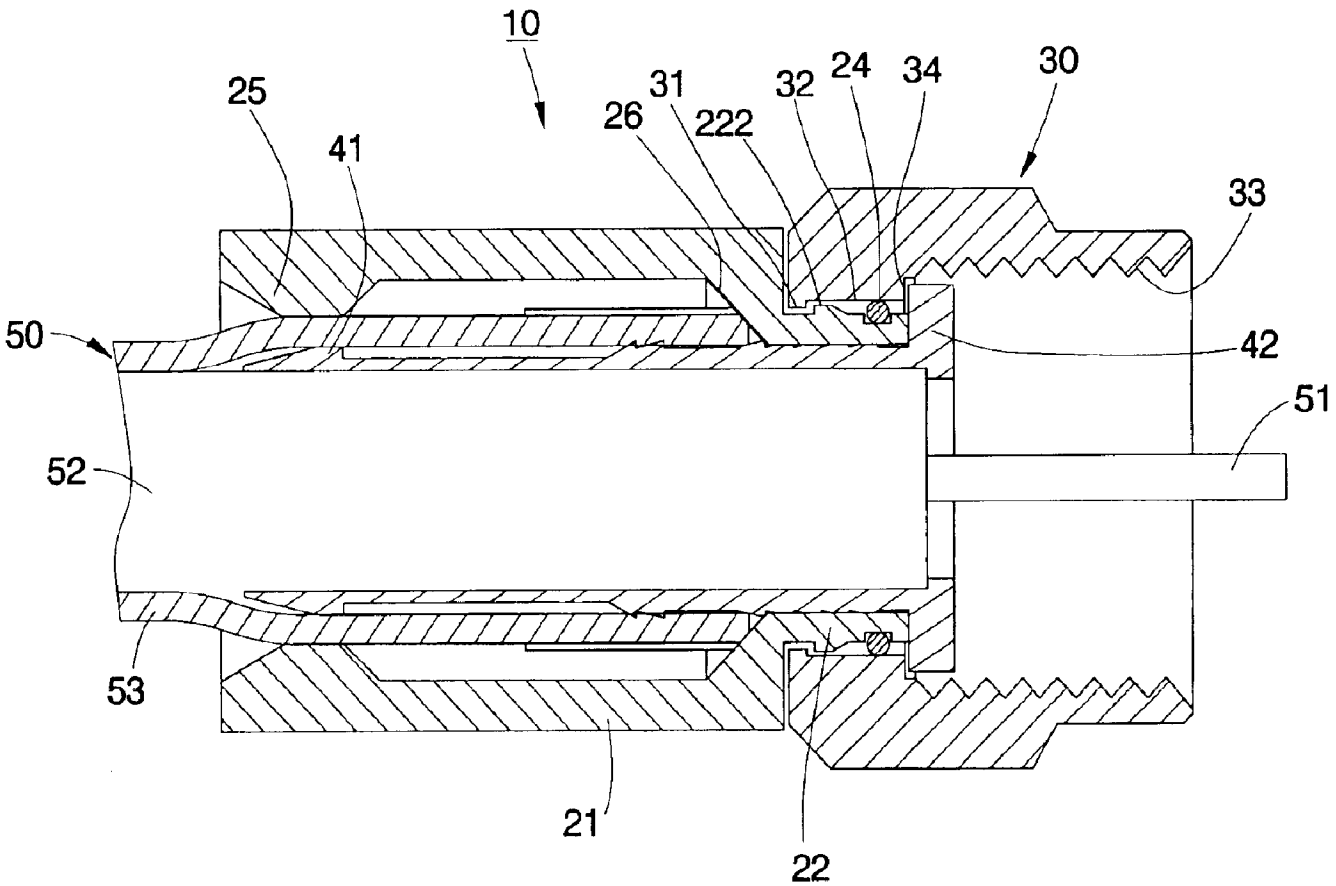
FIG. 5 is a sectional view following FIG. 4, showing the cable being secured.

As shown in FIG. 4 and FIG. 5, the cable terminal 10 of the present invention is connected to a cable 50. The cable 50 has a conductive core 51 at a center warped by an isolating layer 52 and an insulating layer 53. In assembly, the base 20 of the cable terminal 10 is fitted to the insulating layer 53 of the cable 50, and then the outer member 30 is held by a wrench or pliers to fit it to the base 20. Now, exert the outer member 30 to attach the insulating layer 53 of the cable 50 on the stop flat 26 of the base 20 and to engage the first protrusion portion 31 of the outer member 30 with the annular protrusion 222 of the base 20, such that the outer member 30 is secured to the base 30 firmly. After that, exert the engaging member 40 to insert the second engaging portion 41 into the cable 50 between the isolating layer 52 and the insulating layer 53, in which the plate 42 of the engaging member 42 compresses the second protrusion portion 32 of the outer member 30 to move the outer member 30 inward. While first protrusion portion 31 is moved to where between the annular wall 23 and the annular protrusion 222 of the base 20, the ring 24 is attached on sidewall of the hole of the outer member 30 and the outer member 30 is free for rotation again. In addition, the second engaging portion 41 of the engaging member 40 and the first engaging portion 25 of the base 20 clip the insulating layer 53 of the cable 50 and the teeth portion 20 compresses the base 20 at the small portion 22.

The advantages of the present invention are: The outer member is not rotary in assembly because the first protrusion portion is engaged with the annular protrusion of the base for facilitation of exerting the second engaging portion to be inserted into the cable. In addition, it has a well strength of the connection of the terminal and the cable because that the teeth portion of the engaging member is engaged with the small portion of the base firmly and the first engaging portion of the base and the second engaging portion of the engaging member clip the insulating layer.

What is claimed is:

1. A cable terminal, comprising:

a base having a hole, a large portion, a small portion and an annular wall between the large portion and small portion, wherein the small portion has an annular protrusion at a circumference thereof and a tilted guiding flat beside the annular protrusion;

an outer member having a hole having a plurality of sections with various diameters, wherein a first protrusion portion is formed on a sidewall of the narrowest section of the hole, a second protrusion portion is formed on a sidewall of the hole next to the first protrusion portion, a thread is formed on a sidewall of the widest section of the hole and a stop portion is formed between the second protrusion portion and the thread and further wherein the diameter of the hole at the first protrusion portion is greater than that of the small portion of the base and is smaller than that of the annular protrusion of the base;

the outer member fitted to the smaller portion of the base with the first protrusion portion crossing the guiding flat and engaged with the annular protrusion;

an engaging member received in both of the base and the outer member and having a plate at an end thereof against the stop portion of the outer member to move the outer member toward the base, in which the first protrusion portion is moved to where between the annular flat and the annular protrusion of the base.

2. The cable terminal as defined in claim 1, wherein the base has a first engaging portion on a sidewall of the hole and the engaging member has a second engaging portion adjacent to the first engaging portion.

3. The cable terminal as defined in claim 1 wherein the base has a slot on the circumference, in which a ring is mounted to be attached on the sidewall of the hole of the outer member.

4. The cable terminal as defined in claim 1, wherein the engaging member has a teeth portion on a circumference thereof, which has a plurality of tilted teeth, to compress the small portion of the base.

* * * * *